US006886523B2

(12) United States Patent
Steffes et al.

(10) Patent No.: US 6,886,523 B2
(45) Date of Patent: May 3, 2005

(54) ENGINE AND PUMP ASSEMBLY HAVING COMBINED HOUSING

(75) Inventors: Kevin Steffes, Fond du Lac, WI (US); Dennis Stenz, Mt. Calvary, WI (US); Neil Veldman, Plymouth, WI (US); Kenneth J. Stenz, Mt. Calvary, WI (US); Giuseppe Ghelfi, Turin (IT); Paolo Mion, Turin (IT)

(73) Assignee: Tecumseh Products Company, Tecumseh, MI (US)

( * ) Notice: Subject to any disclaimer, the term of this patent is extended or adjusted under 35 U.S.C. 154(b) by 33 days.

(21) Appl. No.: 10/402,562

(22) Filed: Mar. 28, 2003

(65) Prior Publication Data

US 2004/0191091 A1 Sep. 30, 2004

(51) Int. Cl.[7] ..... F01P 5/10
(52) U.S. Cl. ..... 123/196 R; 123/41.47
(58) Field of Search ..... 123/196 R, 41.47, 123/41.44

(56) References Cited

U.S. PATENT DOCUMENTS

| | | | | | |
|---|---|---|---|---|---|
| 2,676,559 | A | * | 4/1954 | Davies | 440/53 |
| 4,155,333 | A | * | 5/1979 | Maggiorana | 123/41.44 |
| 4,643,652 | A | | 2/1987 | Eberhardt | 417/364 |
| 5,117,796 | A | * | 6/1992 | Tursky | 123/509 |
| 5,494,414 | A | * | 2/1996 | Steinhart et al. | 417/360 |
| 5,546,901 | A | * | 8/1996 | Acker et al. | 123/195 C |
| 5,556,264 | A | | 9/1996 | Simonette | 417/307 |
| 5,584,672 | A | | 12/1996 | Simonette | 417/307 |
| 5,653,584 | A | * | 8/1997 | Mazzucato et al. | 417/360 |
| 5,700,137 | A | | 12/1997 | Simonette | 417/364 |
| 5,975,863 | A | * | 11/1999 | Mazzucato | 417/269 |
| 5,980,220 | A | * | 11/1999 | Mazzucato et al. | 417/360 |
| 6,048,179 | A | * | 4/2000 | Forster | 417/364 |
| 6,092,998 | A | * | 7/2000 | Dexter et al. | 417/360 |
| 6,450,783 | B1 | * | 9/2002 | Gokan et al. | 417/364 |
| 6,732,680 | B1 | * | 5/2004 | Beltramo et al. | 123/41.44 |

OTHER PUBLICATIONS

Campbell Hausfeld Pressure Washer Pumps Replacement Parts List, date believed to be 2000.

* cited by examiner

*Primary Examiner*—Marguerite McMahon
*Assistant Examiner*—Jason Benton
(74) *Attorney, Agent, or Firm*—Baker & Daniels

(57) ABSTRACT

A combination of an engine and a pump. An integral first housing section defines a portion of both the engine housing and the pump housing and has a first major surface which defines a portion of the interior engine housing surface and an oppositely disposed second surface which defines a portion of the interior pump housing surface. The first housing section has an opening and a first bearing is disposed therein. The crankshaft extends through the opening and is supported by the first bearing. A pump driving mechanism, such as a wobble plate or camming member, is coupled with the freely extending length of the crankshaft projecting beyond the first bearing. The first major surface may define an oil sump within the engine and an oil passage extending between the first and second major surfaces may communicate oil between the engine and the pump.

7 Claims, 5 Drawing Sheets

ENGINE AND PUMP ASSEMBLY HAVING COMBINED HOUSING

BACKGROUND OF THE INVENTION

1. Field of the Invention

The present invention relates to engine and pump assemblies and, more particularly to a combined housing section which defines a portion of both the engine housing and the pump housing.

2. Description of the Related Art

The combination of an internal combustion engine with a pump unit is known in the art. Pressure washers which include an internal combustion engine, such as a gasoline powered engine having a vertically oriented crankshaft, and a water pump are a well known example of such a combination. Typically, the engines and pumps used to form such pressure washers each have their own separate housings and when the engine and pump are combined, the housings are bolted together and a means of coupling the engine crankshaft to the shaft of the pump is provided. Although existing pressure washers are effective for their purposes, an improved and cost efficient pressure washer is desirable.

SUMMARY OF THE INVENTION

The present invention provides a pump system having an internal combustion engine and a pump wherein a single integral housing section is used to form a part of both the engine housing and the pump housing.

The invention comprises, in one form thereof, a pump system which includes an internal combustion engine having a crankshaft and an engine housing. The crankshaft is operably coupled to at least one piston and the engine housing has an engine housing interior surface defining and at least partially enclosing an engine space. The system also includes a pump having a pump housing and a driving mechanism. The pump housing has a pump housing interior surface which defines and at least partially encloses a pump space. An integral first housing section defines a portion of both the engine housing and the pump housing. The first housing section has a first major surface and an oppositely disposed second major surface. The first major surface defines a portion of the engine housing interior surface and at least a portion of an oil sump disposed within the engine space. The second major surface defines a portion of the pump housing interior surface. The first housing section also has a shaft opening extending through the first housing section from the first major surface to the second major surface. A first bearing is disposed within the shaft opening and is engaged with the crankshaft. The crankshaft has a distal end projecting through the first housing section and a freely extending length disposed within the pump space. The driving mechanism is operably coupled with the freely extending length of the shaft and the bearing support for the crankshaft from proximate the first housing section to the distal end consists essentially of the first bearing, i.e., the first bearing is the only bearing engaged with the crankshaft from proximate the first housing section to the distal end of the crankshaft.

The pump may be an axial pump wherein the driving mechanism is a wobble plate secured to the distal end of the crankshaft. The pump may alternatively be a radial pump wherein the driving mechanism includes at least one camming member operably coupled to the freely extending length of the crankshaft. The first housing section may also include at least one oil passage extending between the first and second major surfaces and providing fluid communication between the engine space and the pump space whereby lubricating oil may be communicated therebetween. The crankshaft may be a vertically oriented crankshaft. The first integral housing section may also include an integral mounting flange wherein the pump system is mountable by bearing securement of the mounting flange.

The invention comprises, in another form thereof, a pump system which includes an internal combustion engine having a crankshaft and an engine housing. The crankshaft is operably coupled to at least one piston and the engine housing has an engine housing interior surface defining and at least partially enclosing an engine space. The system also includes a pump having a pump housing and a driving mechanism. The pump housing has a pump housing interior surface defining and at least partially enclosing a pump space. An integral first housing section defines a portion of both the engine housing and the pump housing and has a first major surface and an oppositely disposed second major surface. The first major surface defines a portion of the engine housing interior surface and at least a portion of an oil sump disposed within the engine space. The second major surface defines a portion of the pump housing interior surface. The first housing section also has a shaft opening extending through the first housing section from the first major surface to the second major surface and an oil passage extending from the first major surface to the second major surface. The oil passage provides fluid communication between the engine space and the pump space. A first bearing is disposed within the shaft opening and is engaged with the crankshaft. The crankshaft has a distal end projecting through the first housing section and a freely extending length disposed within the pump wherein the driving mechanism is operably coupled with the freely extending length of the shaft.

The invention comprises, in yet another form thereof, a method of combining an engine with a pump. The method includes providing an internal combustion engine having a housing and a crankshaft operably coupled with at least one piston. Also provided is a pump having a driving mechanism and a housing. An integral first housing section is formed having a first major surface, an oppositely disposed second major surface and a shaft opening extending between the first and second major surfaces. The method also includes mounting a first bearing in the shaft opening in the first housing section and securing the first housing section to a second engine housing section and to a second pump housing section wherein the first major surface defines a portion of an interior surface of the engine housing and the second major surface defines a portion of an interior surface of the pump housing. The crankshaft is rotatably supported with the first bearing wherein the crankshaft has a distal end projecting through the first housing section and a freely extending length disposed within the pump housing. The method also includes operably coupling the driving mechanism to the freely extending length of the crankshaft and communicating a lubricating oil between the engine and the pump.

The pump may be an axial pump and the step of operably coupling the driving mechanism may include attaching a wobble plate to the distal end of the crankshaft. The pump may alternatively be a radial pump and the step of operably coupling the driving mechanism may include operably coupling at least one camming member to the freely extending length of the crankshaft. The first housing section may define an oil passage extending between the first major surface and the second major surface and the step of communicating a lubricating oil between the engine and the pump may include communicating a lubricating oil through the oil passage. The bearing support for the crankshaft from proximate the first housing section to the distal end of the crankshaft may consist essentially of the first bearing. The crankshaft may be a vertically oriented crankshaft and the first major surface may define at least a portion of an oil sump disposed within the engine housing.

An advantage of the present invention is that by providing an integral housing section which defines a portion of both the engine housing and the pump housing, the number of parts used to manufacture the pump system can be reduced thereby creating cost efficiencies. For example, when an engine and pump are each enclosed by separate housings which are then secured together, the pump will oftentimes have a shaft which is separate from the crankshaft of the engine and must be joined thereto. Moreover, when two separate housings are joined together, each of the housings will oftentimes have a bearing whereby a shaft extending through both of the housings will be supported by two bearings placed in close proximity to each other.

The inventors of the present invention have recognized these deficiencies and provided an integral housing section which allows the driving mechanism of the pump, e.g., a wobble plate, camming member or other suitable driving mechanism, to be coupled to the crankshaft of the engine near its distal end instead of using a separate pump shaft and the use of a single bearing to support the crankshaft from the area proximate the integral housing section to the distal end of the crankshaft.

Another advantage of some embodiments of the present invention is that the integral housing section may be used to define at least a portion of an oil sump within the engine housing and an oil passage may extend through the integral housing section to allow lubricating oil to be communicated from the engine to the pump.

Yet another advantage of some embodiments of the present invention is that it provides an integral housing section which may also include an integral mounting flange. The mounting flange may be used to mount the combined engine and pump assembly on a support structure.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
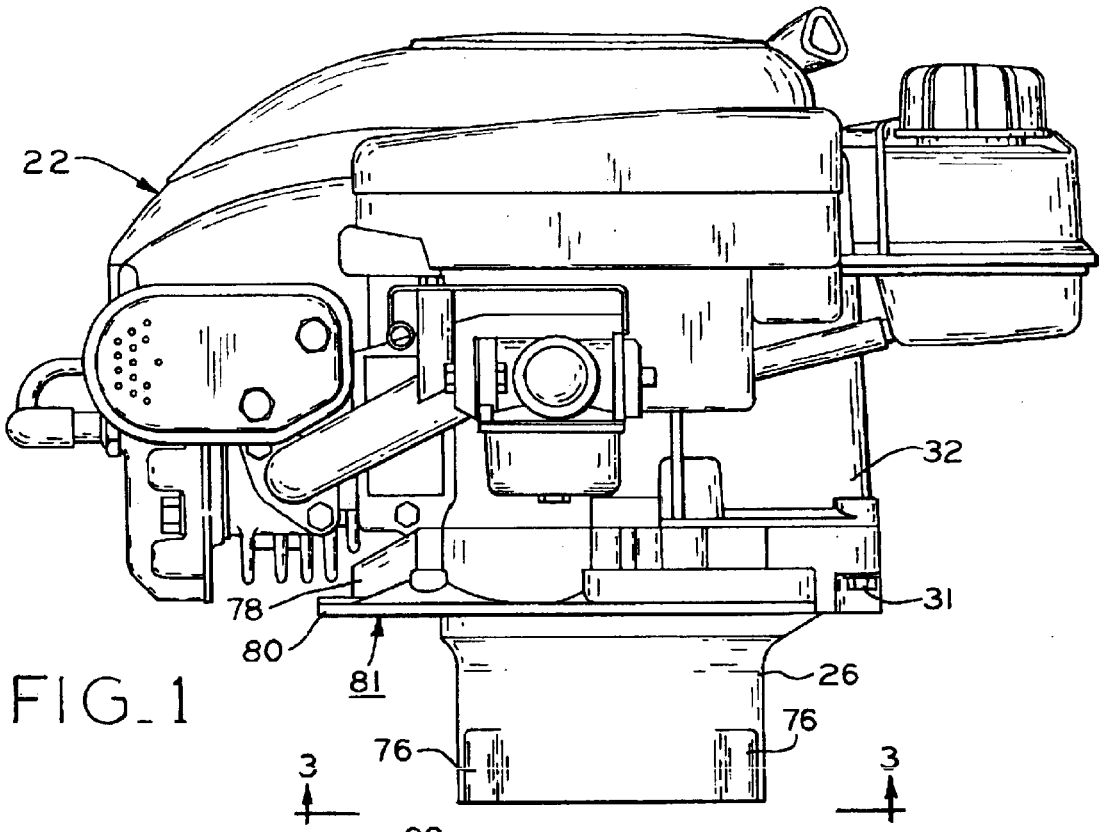
FIG. 1 is a side view of a first embodiment of the present invention.

Corresponding reference characters indicate corresponding parts throughout the several views. Although the exemplification set out herein illustrates the invention in several forms, the embodiments disclosed below are not intended to be exhaustive or to be construed as limiting the scope of the invention to the precise forms disclosed.

DESCRIPTION OF THE PRESENT INVENTION

Figure 3:
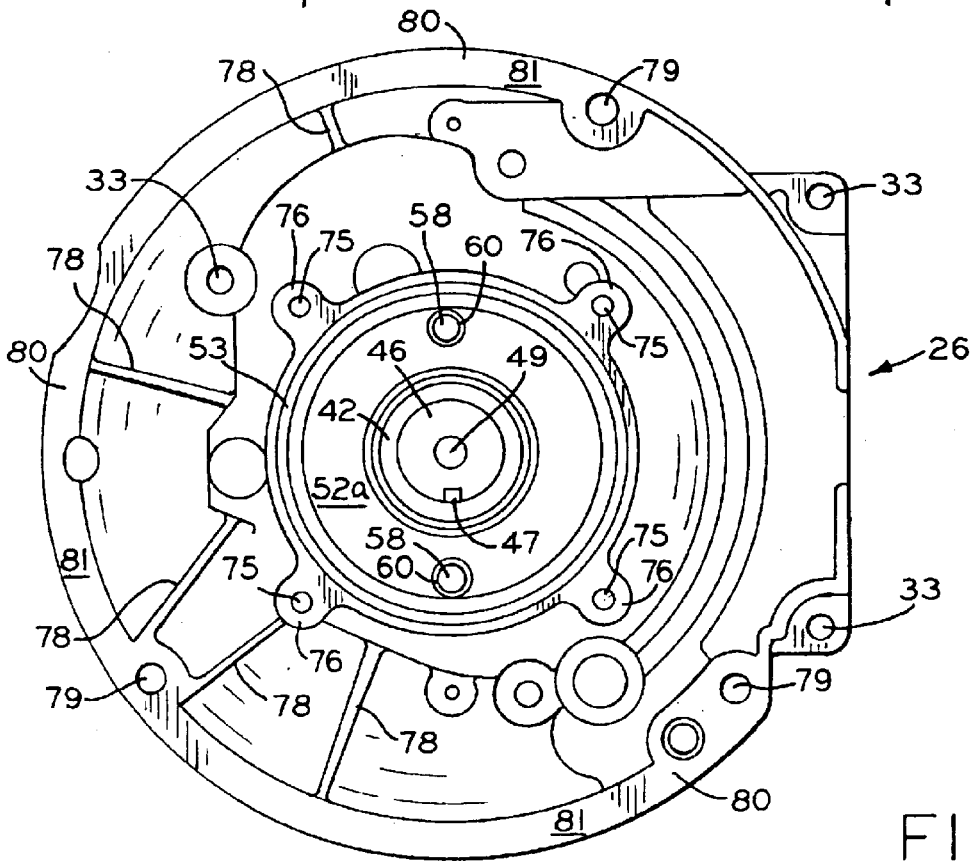
FIG. 3 is a bottom view of a combined housing section of the first embodiment.
Figure 2:
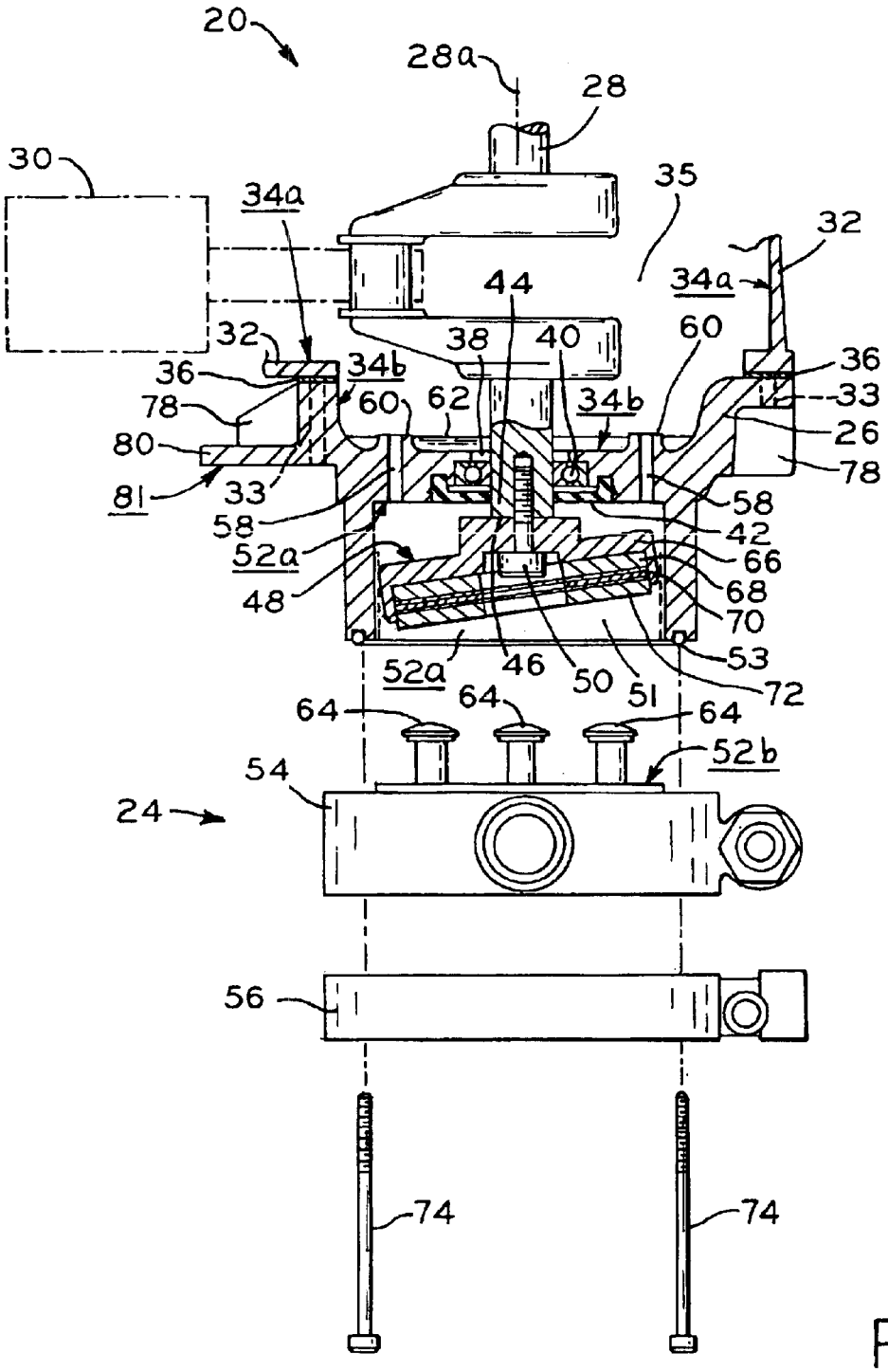
FIG. 2 is an exploded partial cross sectional view of the first embodiment.

In accordance with the present invention, a pump system 20 is shown in FIGS. 1–3. Pump system 20 includes an internal combustion engine 22 and an axial pump 24. Apart from combined housing section 26, engine 22 is a conventional gasoline powered engine. For example, the family of vertical crankshaft engines currently manufactured by Tecumseh Products Company which is headquartered in Tecumseh, Mich., and commercially available under the trademark Formula® could be adapted for use with the present invention.

Engine 22 includes a crankshaft 28 which is coupled with one or more pistons 30. Pistons 30 are schematically represented in dashed outline in the Figures. Engine 22 also includes a housing which includes an upper section 32 which is joined to combined housing section 26. Upper engine housing section 32 has an interior surface 34*a* and combined housing section 26 has an interior surface 34*b*. Each of the interior surfaces 34*a* and 34*b* form a portion of the interior engine housing surface which defines and at least partially encloses an engine space 35. Bolt holes 33 provided in combined housing section 26 receive threaded bolts 31 which engaged threaded bores in housing section 32 to secure housing sections 26 and 32 together. Other methods of joining housing sections 26 and 32 may also be employed. A seal 36 is positioned between housing sections 26, 32 to prevent oil from leaking therebetween. In the illustrated embodiment, housing section 26 is formed out of a single integral cast metal part and is manufactured using conventional manufacturing methods.

In the illustrated embodiment, the rotational axis 28*a* of crankshaft 28 is vertically oriented and crankshaft 28 extends through a shaft opening 38 in housing section 26. A roller bearing 40 is positioned in opening 38 and rotatably supports crankshaft 28. A sealing member 42 is also located in opening 38 below bearing 40 and engages crankshaft 28 to prevent the migration of oil through opening 38. Crankshaft 28 has an unsupported freely extending length 44 which projects beyond bearing 40 into pump 30 and terminates at the distal end 46 of crankshaft 28. A wobble plate assembly 48 is secured to distal end 46 of crankshaft 28 with a threaded bolt 50 which engages threaded bore 49 in crankshaft 28. The operation of wobble plate assembly 48 is discussed in greater detail below.

Combined housing section 26 has a surface 52*a* which forms a portion of the interior surface of the pump housing which encloses wobble plate assembly 48. Pump body 54 defines additional surfaces 52*b* which together with surface 52*a* form the interior surface of the pump housing which defines a pump space 51 and encloses wobble plate assembly 48. An O-ring seal 53 is seated in a groove on combined housing section 26 to seal the interface between combined housing section 26 and pump body 54. Threaded bolts are inserted through openings in pump housing section 56 and pump body 54 and engage threaded bores located in bosses 76 located on the outside circumference of combined housing section 26. Wobble plate assembly 48, pump body 54 and pump housing section 56 are commercially available from Campbell Hausfeld, having a place of business at 100

Production Drive, Harrison, Ohio, 45030 under pressure water pump part numbers PM040140SJ (Aluminum head pump) or PM040130SJ (Brass head pump).

As best seen in FIG. 2, surface 34*b* forms a first major surface on combined housing section 26 and surface 52*a* forms a second major surface on combined housing section 26 which is disposed opposite surface 34*b*. Also seen in FIG. 2, are oil passages 58 which extend from engine interior surface 34*b* through the thickness of combined housing section 26 to pump interior surface 52*a*. Oil passages 58 extend through projections 60 whereby the openings to oil passages 58 in surface 34*b* are located vertically above the lowermost portion of surface 34*b*. The volume defined in the engine space below the openings to passages 58 forms an oil sump 62 where lubricating oil may pool within the engine housing. Once the pooled lubricating oil has risen to the height of the openings to passages 58, any additional oil collected in oil sump 62 will enter passages 58 and be communicated by gravity to pump 24. As can be seen in FIG. 2, oil communicated through passages 58 will enter the pump space enclosing wobble plate assembly 48 and displacement pistons 64 where such oil may lubricate these parts. In the illustratede embodiment, engine 22 includes a positive displacement pump (not shown) to distribute oil within engine 22, however, other methods of distributing oil within engine 22 may alternatively be employed.

In the illustrative embodiment, two oil passages are included in combined housing section 26 but a single passage, or additional passages, could alternatively be employed. Additionally, oil passage could have alternative configurations and orientations and still provide for the communication of oil between engine 22 and pump 24. It is also possible to form passages 58 using threaded bores whereby a threaded plug may be inserted in passages 58 to prevent the migration of oil between engine 22 and pump 24. Such an embodiment could be used to with pump systems both where it is desired to exchange oil between engine 22 and pump 24 and where it is not desirable to exchange oil between engine 22 and pump 24 by the selective use of plugs within such threaded passages.

In operation, pistons 30 drivingly rotate crankshaft 28 which in turn rotates wobble plate assembly 48. Crankshaft 28 includes a slot 47 to rotationally key crankshaft 28 together with wobble plate assembly 48 whereby rotational slippage between crankshaft 28 and wobble plate assembly 48 is prevented. Wobble plate assembly 48 includes a wobble plate 66, a bearing disk 68, a needle bearing 70, and a thrust shoe 72. As wobble plate assembly 48 is rotated, thrust shoe 72 bears against displacement pistons 64 translating the rotational motion of crankshaft 28 into the linear reciprocating motion of pistons 64. Pump body 54 defines cylinders, sealingly separated from the pump space enclosing wobble plate assembly 48, in which pistons 64 reciprocate to provide a pumping action. Pump body 54 is provided with an inlet and outlet through which water enters and is discharged from pump body 54.

In the illustrated embodiment, combined housing section 26 has a mounting flange 80 which extends around a substantial portion of the outer perimeter of housing section 26 and includes a substantially planar mounting surface 81. Pump system 20 is mountable on a support structure by the bearing securement of mounting flange 80. For example, mounting surface 81 on flange 80 may be placed in bearing engagement with a generally planar deck member or other structure and flange 80 secured thereto whereby pump system 20 may be mounted on a support structure such as a wheeled frame having a deck. Such a deck member may have an opening through which the lower portion of housing section 26 and the remainder of pump 24 projects. Mounting flange 80 includes openings 79 for receiving bolts to facilitate the mounting and securement of pump system 20. Stiffening ribs 78 are disposed about the perimeter of housing section 26 to enhance the structural integrity of housing section 26. In the illustrated embodiment, mounting flange 80 and stiffening ribs 78 are formed by the same integral cast metal part defining surfaces 34*b* and 52*a*.

While the first embodiment employs a wobble plate assembly 48 coupled with the engine crankshaft to provide the driving mechanism of the pump, the second and third embodiments discussed below employ a camming member 85, 85" coupled to the engine crankshaft as the driving mechanism of the pump. Other types of driving mechanisms and pump assemblies may also be employed with the present invention.

Figure 4:
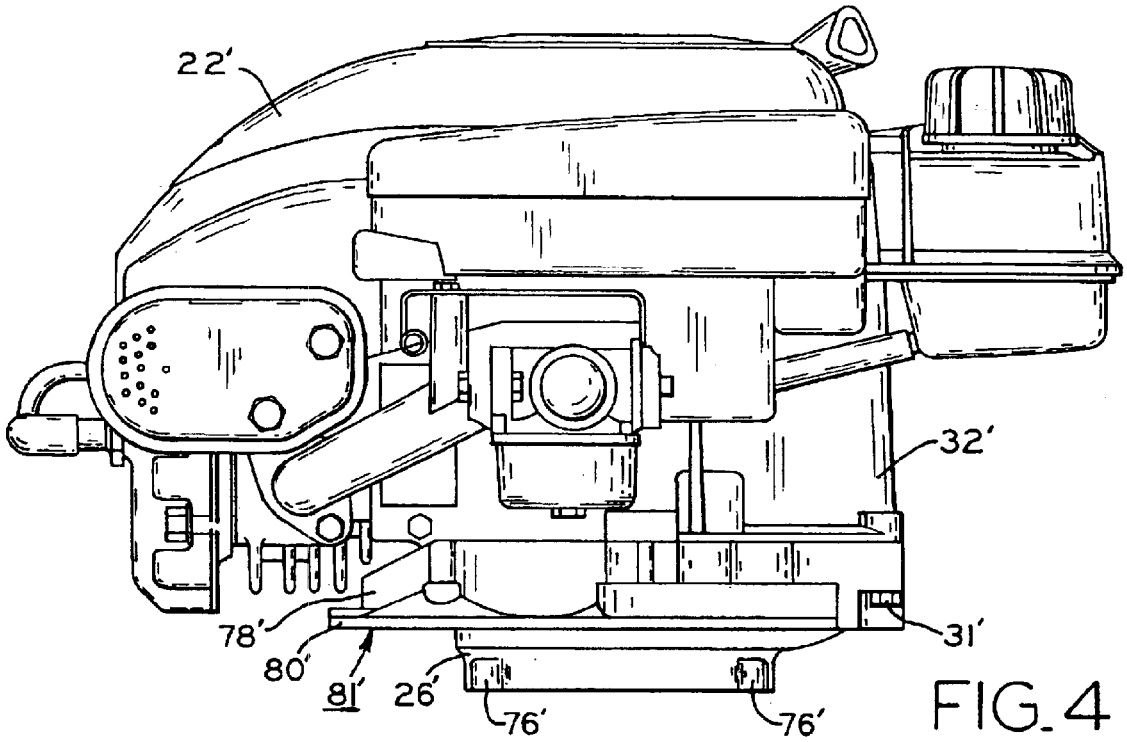
FIG. 4 is a side view of a second embodiment of the present invention.
Figure 6:
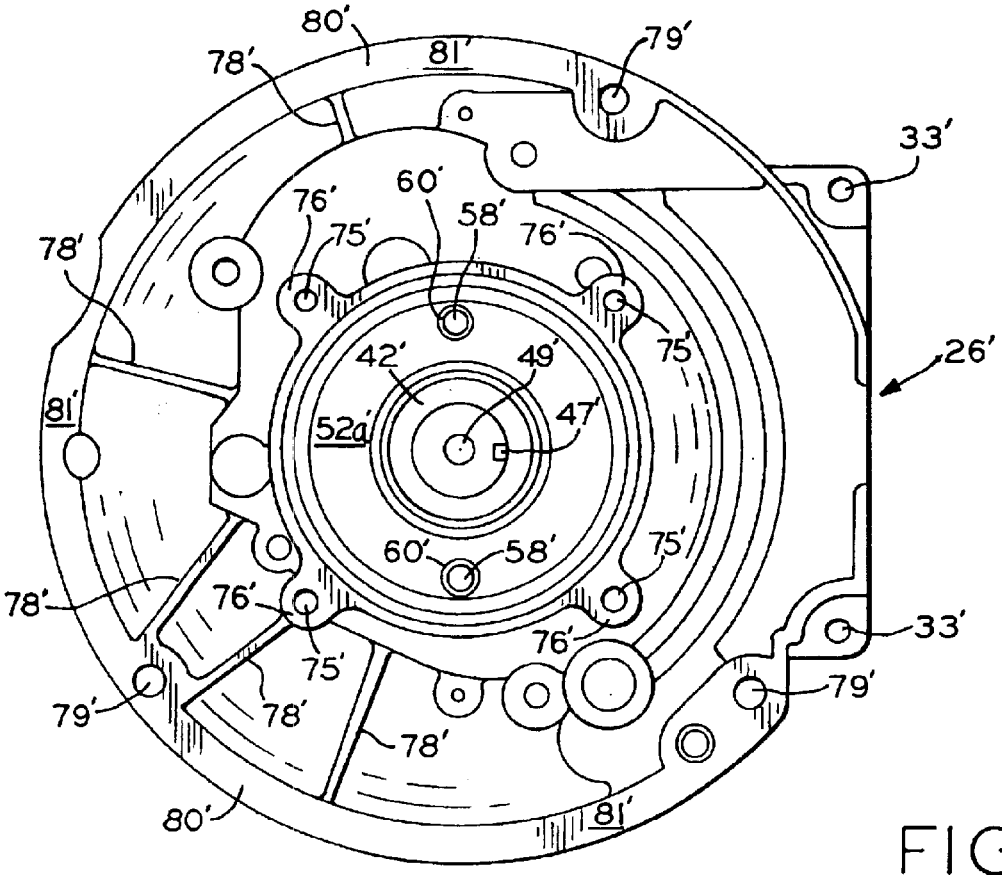
FIG. 6 is a bottom view of a combined housing section of the second embodiment.
Figure 5:
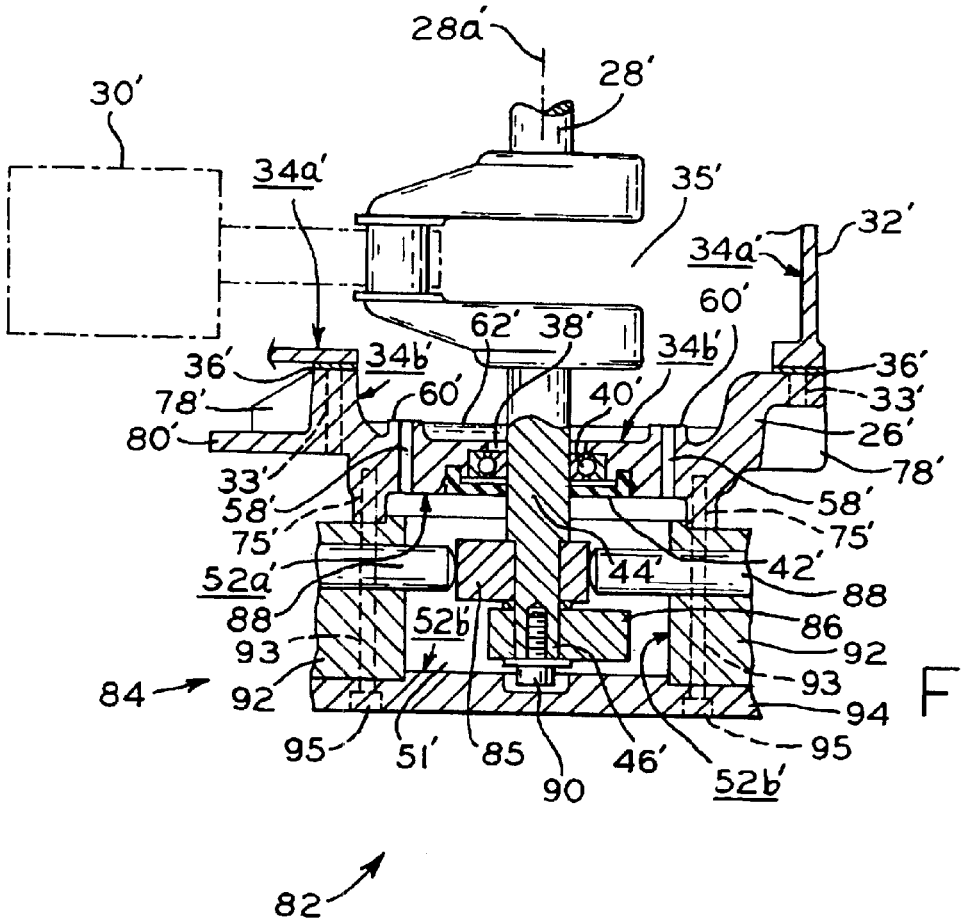
FIG. 5 is a partial cross sectional view of the second embodiment.

A second embodiment of the invention is illustrated in FIGS. 4–6. Unlike pump system 20, pump system 82 utilizes a radial pump 84 instead of an axial pump. Those features which are similar in both the first and second embodiment are identified in the second embodiment using prime reference characters and a description of features common to each embodiment can be found above in the discussion of the first embodiment. As can be seen in FIG. 5, a camming member 85 and a counterweight 86 are mounted on the freely extending length 44' of crankshaft 28' disposed within pump space 51'. Camming member 85 has a radially eccentric shape and as it rotates with crankshaft 28' it causes the reciprocating movement of displacement pistons 88. Counterweight 86 balances the eccentric load on crankshaft 28' generated by camming member 85. Camming member 85 and counterweight 86 have radially inwardly directed projections which interfit with slot 47' on distal end 46' of crankshaft 28' to rotationally fix camming member 85 and counterweight 86 on crankshaft 28'. A bolt 90 engages threaded bore 49' on the distal end 46' of crankshaft 28' to axially secure camming member 85 and counterweight 86 on crankshaft 28'. Other methods of securing a camming member and counterweight to crankshaft 28' may be employed in alternative embodiments.

Radial pump 84 also includes a pump body 92 and pump housing section 94 and functions in a conventional manner. Radial pump assemblies are well known in the art as exemplified by the disclosure of U.S. Pat. No. 5,700,137 which is hereby incorporated herein by reference. Pump body 92 and pump housing section 94 include bolt passages 93, 95 respectively for receiving bolts which threadingly engage bores 75' located in bosses 76' and thereby secure pump body 92 and pump housing section 94 to combined housing section 26'.

Figure 7:
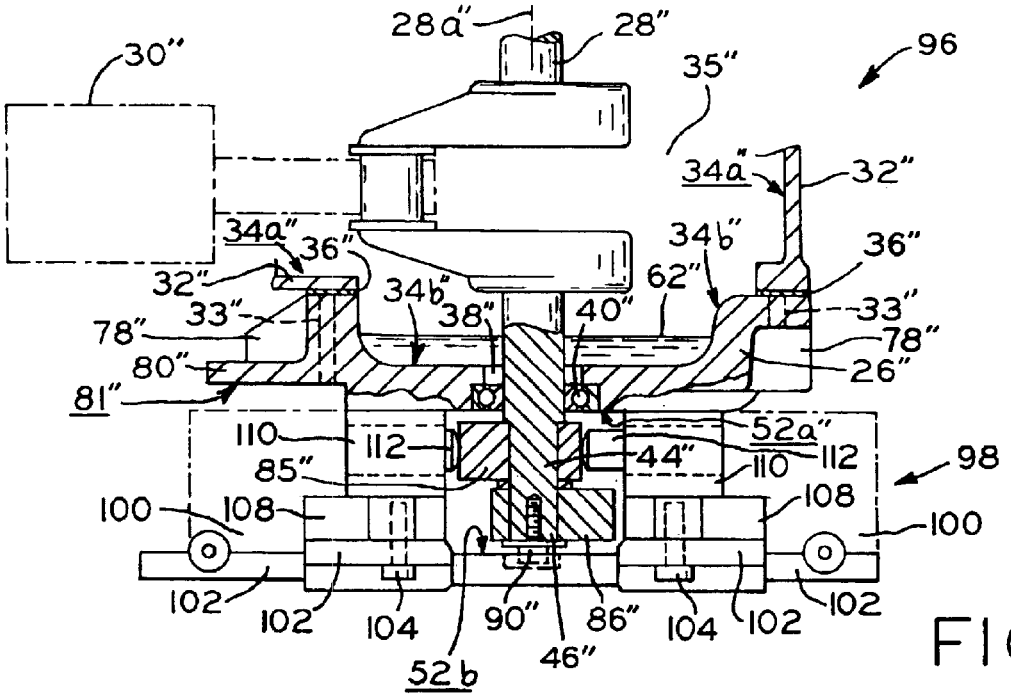
FIG. 7 is a partial cross sectional view of a third embodiment.
Figure 8:
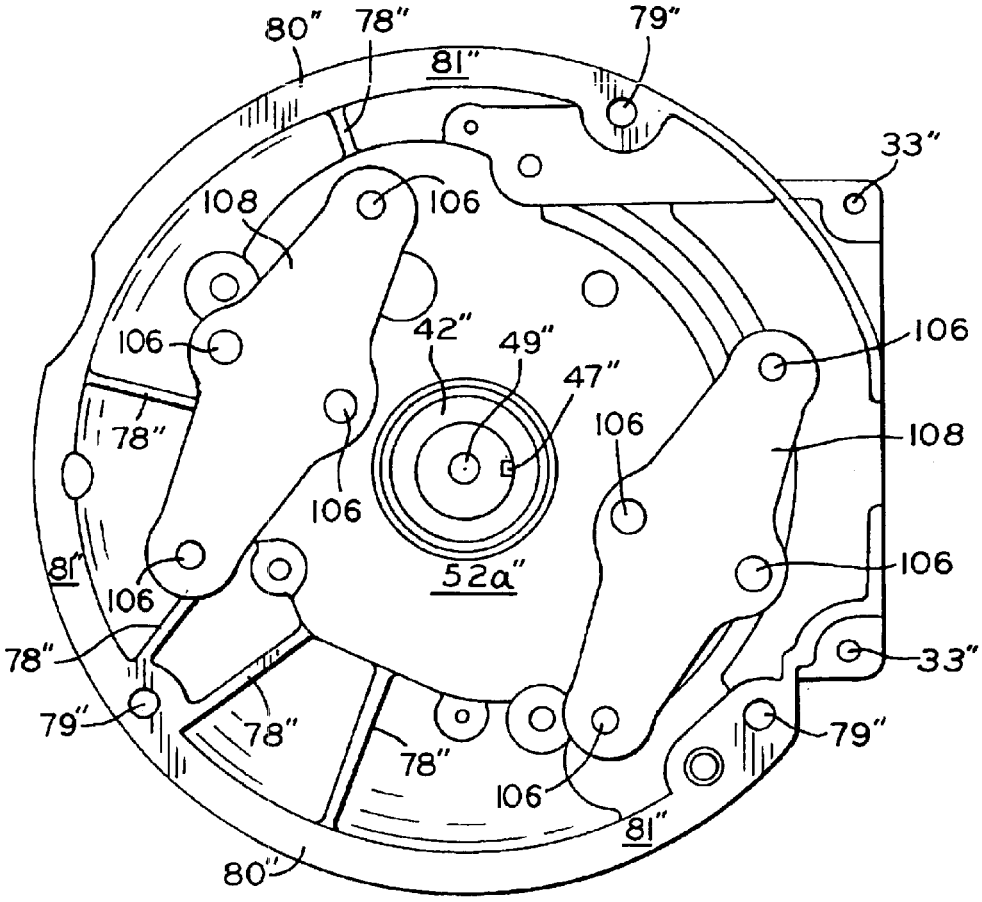
FIG. 8 is a bottom view of a combined housing section of the third embodiment.

A third embodiment of the invention is schematically illustrated in FIGS. 7 and 8. Pump system 96 utilizes a radial pump 98 but, as discussed in greater detail below, the pump housing does not fully enclose the pump driving mechanism. Those features of the third embodiment which are similar to features found in the first or second embodiment are identified in the third embodiment using double prime reference characters and a description of the common features of the third embodiment can be found above in the discussion of the first or second embodiment.

In the third embodiment, an integral housing section 26" includes a surface 34*b*" which forms a portion of the interior engine housing surface and also defines an oil sump 62" within the engine housing. A surface 52*a*" is disposed opposite surface 34*b* and defines a portion of an interior facing surface of the pump housing. Surface 52*a*" and surface 52*b*" located on lower pump housing section 102 define a pump space which partially encloses the freely extending length 44" of crankshaft 28" which projects outwardly of the engine housing and which has a camming member 85" and a counterweight 86" mounted thereon.

The pump side of housing section 26" includes two outwardly projecting columns 110 having mounting flanges 108 at their distal ends. Mounting flanges 108 define threaded openings 106 which receive bolts 104 to mount the bottom pump housing section 102 thereto. Displacement pistons 112 extend through openings in columns 110 and are received in cylinders defined by pump bodies 100. Pistons 112 engage camming member 85" and reciprocate within pump bodies 100 and function in the same manner as a conventional radial pump.

Unlike pumps 24 and 84, pump 98 does not fully enclose the driving mechanism of the pump, i.e., camming member 85", positioned within the pump housing. Consequently, housing section 26" does not provide for the communication of lubricating oil between the engine and the pump and housing section 26" is sealed to prevent the loss of fluids from the interior of the engine housing. Although not shown in FIG. 7, an oil seal 42" (FIG. 8) may be positioned below bearing 40" to seal the interface between housing section 26" and crankshaft 28" and prevent the migration oil through opening 38".

While this invention has been described as having an exemplary design, the present invention may be further modified within the spirit and scope of this disclosure. This application is therefore intended to cover any variations, uses, or adaptations of the invention using its general principles.

What is claimed is:

1. A pump system comprising:

an internal combustion engine, said engine including a crankshaft and an engine housing, said crankshaft operably coupled to at least one piston, said engine housing having an engine housing interior surface defining and at least partially enclosing an engine space;

a pump having a pump housing and a driving mechanism, said pump housing having a pump housing interior surface defining and at least partially enclosing a pump space;

an integral first housing section defining a portion of both said engine housing and said pump housing, said first housing section having a first major surface and an oppositely disposed second major surface, said first major surface defining a portion of said engine housing interior surface and defining at least a portion of an oil sump disposed within said engine space and said second major surface defining a portion of said pump housing interior surface, said first housing section having a shaft opening extending through said first housing section from said first major surface to said second major surface; and a first bearing disposed within said shaft opening and engaged with said crankshaft, said crankshaft having a distal end projecting through said first housing section and a freely extending length disposed within said pump, said driving mechanism operably coupled with said freely extending length of said shaft and wherein bearing support for said crankshaft from proximate said first housing section to said distal end consists essentially of said first bearing; wherein said first housing section further defines at least one oil passage extending between said first and second major surfaces and providing fluid communication between said engine space and said pump space.

2. A method of combining an engine with a pump, said method comprising:

providing an internal combustion engine having a housing and a crankshaft operably coupled with at least one piston;

providing a pump having a driving mechanism and a housing;

forming an integral first housing section having a first major surface and an oppositely disposed second major surface, said first housing section further defining a shaft opening extending between said first and second major surfaces;

mounting a first bearing in said shaft opening in said first housing section;

securing said first housing section to a second engine housing section and to a second pump housing section wherein said first major surface defines a portion of an interior surface of said engine housing and said second major surface defines a portion of an interior surface of said pump housing;

rotatably supporting said crankshaft with said first bearing wherein said crankshaft has a distal end projecting through said first housing section and a freely extending length disposed within said pump housing;

operably coupling said driving mechanism to said freely extending length of said crankshaft; and communicating a lubricating oil between said engine and said pump.

3. The method of claim 2 wherein said pump is an axial pump and said step of operably coupling said driving mechanism includes attaching a wobble plate to said distal end of said crankshaft.

4. The method of claim 2 wherein said pump is a radial pump and said step of operably coupling said driving mechanism includes operably coupling at least one camming member to said freely extending length of said crankshaft.

5. The method of claim 2 wherein said first housing section defines an oil passage extending between said first major surface and said second major surface and the step of communicating a lubricating oil between said engine and said pump includes communicating a lubricating oil through said oil passage.

6. The method of claim 2 wherein bearing support for said crankshaft from proximate said first housing section to said distal end consists essentially of said first bearing.

7. The method of claim 2 wherein said crankshaft is a vertically oriented crankshaft and said first major surface defines at least a portion of an oil sump disposed within said engine housing.

* * * * *